US011578872B2

(12) United States Patent
Yao et al.

(10) Patent No.: US 11,578,872 B2
(45) Date of Patent: Feb. 14, 2023

(54) BURNER HEAD OF BURNER FOR GAS COOKTOP, BURNER FOR GAS COOKTOP, AND GAS COOKTOP

(71) Applicant: BSH Hausgeräte GmbH, Munich (DE)

(72) Inventors: Xingen Yao, Nanjing (CN); Xinxin Zhao, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 320 days.

(21) Appl. No.: 16/619,486

(22) PCT Filed: Jun. 11, 2018

(86) PCT No.: PCT/IB2018/054199
§ 371 (c)(1),
(2) Date: Dec. 5, 2019

(87) PCT Pub. No.: WO2019/008456
PCT Pub. Date: Jan. 10, 2019

(65) Prior Publication Data

US 2020/0141587 A1 May 7, 2020

(30) Foreign Application Priority Data

Jul. 3, 2017 (CN) ..... 201710231591.9

(51) Int. Cl.
*F24C 3/00* (2006.01)
*F23D 14/58* (2006.01)
(Continued)

(52) U.S. Cl.
CPC ..... *F24C 3/008* (2013.01); *F23D 14/58* (2013.01); *F24C 3/085* (2013.01); *F24C 3/126* (2013.01);
(Continued)

(58) Field of Classification Search
CPC .. F24C 3/008; F24C 3/08; F24C 3/085; F24C 15/08; F24C 15/107; F23D 14/58;
(Continued)

(56) References Cited

U.S. PATENT DOCUMENTS 1,818,222 A * 8/1931 Hughes ..... F23D 14/045 239/433
D125,112 S * 11/1941 Reeves ..... D7/407
(Continued)

FOREIGN PATENT DOCUMENTS

CN 2190244 Y * 2/1995 ..... F24C 3/08
CN 201814412 U * 5/2011 ..... A47J 36/34
(Continued)

OTHER PUBLICATIONS

Machine translation of Ding (CN 2190244 Y) (Year: 1995).*
(Continued)

*Primary Examiner* — Vivek K Shirsat
(74) *Attorney, Agent, or Firm* — Michael E. Tschupp; Andre Pallapies; Brandon G. Braun

(57) ABSTRACT

A burner head of a burner for a gas cooktop, a burner, and a gas cooktop are provided. The burner head includes a plurality of supports, where each support includes a support surface for supporting a cooking utensil, the support is further provided with a plurality of gas ports from which gas flows out and forms a flame, and each support has a first working position and a second working position. When the supports are in the first working position, the burner head has a flat upper surface, and the support surfaces of the supports constitute the upper surface, and when the supports are in the second working position, the burner head has a concave surface, and the support surfaces of the supports
(Continued)

constitute the concave surface. The shape of the burner head is changeable, so as to adapt to cooking utensils having different bottom outlines.

19 Claims, 3 Drawing Sheets

(51) Int. Cl.
*F24C 3/08* (2006.01)
*F24C 3/12* (2006.01)
*F24C 15/08* (2006.01)
*F24C 15/10* (2006.01)

(52) U.S. Cl.
CPC ..... *F24C 15/08* (2013.01); *F24C 15/107* (2013.01); *F23D 2208/10* (2013.01); *F23D 2900/14003* (2013.01); *F23D 2900/14004* (2013.01)

(58) Field of Classification Search
CPC ..... F23D 14/583; F23D 14/586; F23D 2900/14003; F23D 2900/14004; F23D 2208/00; F23D 2208/10; A47J 36/34
USPC ..... 126/39 BA, 152 B, 152 R; 99/333, 334, 99/335
See application file for complete search history.

(56) References Cited

U.S. PATENT DOCUMENTS 2,428,998 A * 10/1947 Simpson ..... F23D 14/04 126/39 J
3,091,682 A * 4/1961 Prather ..... F24C 15/104 219/458.1
4,313,416 A * 2/1982 Lau ..... F24C 15/102 126/39 E
5,928,544 A * 7/1999 Bennett ..... A47J 37/0629 219/478
6,435,173 B1 * 8/2002 Miller ..... F24C 15/107 126/39 R
11,022,317 B2 * 6/2021 Lu ..... F24C 3/082
2008/0160465 A1 7/2008 Pryor et al.
2009/0038482 A1 * 2/2009 Ellersiek ..... F24C 15/30 99/449
2010/0005976 A1 * 1/2010 Inzaghi ..... A47J 37/0629 219/478
2013/0270251 A1 * 10/2013 Furuti ..... H05B 3/68 219/445.1
2020/0132308 A1 * 4/2020 Lu ..... F24C 3/082

FOREIGN PATENT DOCUMENTS

CN 106224958 A * 12/2016 ..... F23D 14/02
CN 207569939 U * 7/2018 ..... F24C 15/107
EP 1099904 A1 5/2001
EP 1528325 A2 * 4/2005 ..... F23D 14/08
FR 2701542 A1 8/1994
KR 200438941 Y1 * 3/2008
WO WO-2019048970 A1 * 3/2019 ..... F24C 15/107
WO WO-2020260256 A1 * 12/2020 ..... F23D 14/02

OTHER PUBLICATIONS

Machine Translation of Sachon (EP 1528325 A2) (Year: 2005).*
Machine translation of Xu (CN 201814412 U) (Year: 2011).*
Machine Translation of Zhu et al (CN 106224958 A) (Year: 2016).*
Machine translation of Pan (CN 207569939 U) (Year: 2018).*
Machine Translation of Maruri et al (WO 2019048970 A1) (Year: 2019).*
Machine Translation of Shi et al (WO 20200260256 A1) (Year: 2020).*
이기종, Arising and falling device for burner of roaster (Year: 2008).*
Inernational Search Report PCT/IB2018/054199 dated Sep. 7, 2018.

* cited by examiner

BURNER HEAD OF BURNER FOR GAS COOKTOP, BURNER FOR GAS COOKTOP, AND GAS COOKTOP

CROSS-REFERENCES TO RELATED APPLICATIONS

This application is the U.S. National Stage of International Application No. PCT/ib2018/054199, filed Jun. 11, 2018, 2018, which designated the United States and has been published as International Publication No. WO 2019/008456 A1 and which claims the priority of Chinese Patent Application, Serial No. 201710531591.9, filed Jul. 3, 2017, pursuant to 35 U.S.C. 119(a)-(d).

BACKGROUND

Technical Field

The present invention relates to the field of gas cooktops, and in particular, to a burner head of a burner for a gas cooktop, a burner for a gas cooktop having the burner head, and a gas cooktop having the burner.

Related Art

A conventional gas cooktop usually includes a burner and a pan support disposed surrounding the burner. The burner and the pan support are two components independent of each other. The burner is configured to heat food or water in a cooking utensil, and the pan support is configured to support the cooking utensil. For the gas cooktop, the functions of the two components are indispensable. To some extent, this restricts changes in a structure and an appearance of the gas cooktop.

SUMMARY

In view of the foregoing technical problem, an objective of the present invention is to provide an improved burner head of a burner for a gas cooktop, a burner for a gas cooktop having the burner head, and a gas cooktop having the burner.

To achieve the foregoing technical objective, first, the present invention provides a technical solution as follows: a burner head of a burner for a gas cooktop includes a plurality of supports, where each support includes a support surface for supporting a cooking utensil, the support is further provided with a plurality of gas ports from which gas flows out and forms a flame, each support has at least two working positions, and the at least two working positions include a first working position and a second working position. When the supports are in the first working position, the burner head has a flat upper surface, and the support surfaces of the supports constitute the upper surface; and when the supports are in the second working position, the burner head has a concave surface, and the support surfaces of the supports constitute the concave surface.

The present invention creatively improves, by combining a pan support and a burner head into one, an existing structure in which the pan support and the burner head are independent of each other, so as to obtain a burner head that can support a cooking utensil and have a heating function. This simplifies an external structure of a gas cooktop, obtains a simpler appearance of the gas cooktop, enables a user to clean the gas cooktop more conveniently, and provides the user with a brand-new gas cooktop product.

Beneficial effects of the present invention are further embodied in that each support has at least two working positions, so that the shape of the burner head in the present invention is changeable and may adapt to cooking utensils having different bottom outlines. When the supports are in the first working position, the burner head has a flat upper surface which can support a pan more stably. When the supports are in the second working position, the burner head has a concave surface which can support a wok more stably.

It should be noted that, the "upper surface" and the "concave surface" in the present invention may include a plurality of contiguously connected surfaces or a plurality of surfaces that are not contiguously connected. The "concave surface" should be understood as that an overall outline is of a concave shape.

"Each support has at least two working positions, and the at least two working positions include a first working position and a second working position" should be understood as that, in some embodiments, the support further includes more working positions in addition to the first working position and the second working position. For example, in an embodiment, an angle of the support surface relative to a panel of the gas cooktop is adjustable. In another preferred embodiment, the support includes a plurality of working positions for performing stepless adjustment, so that the burner head can adjust the working position of the supports based on a bottom outline of the cooking utensil, to adjust the supports into a working position matching the bottom outline of the cooking utensil, that is, a working position that enables the support surface to be tangential to a bottom outer surface of the cooking utensil. A ignition pin and a thermocouple may be disposed to move in synchronization with the support.

"A burner head of a burner for a gas cooktop includes a plurality of supports" should be understood as that the burner head includes at least two supports. In an implementation in which the burner head includes two supports, the two supports may be mirror-symmetrically arranged. The supports may extend in a "<" or an arc shape.

In a possible implementation, the burner head of a burner for a gas cooktop includes at least three supports, and a gap exists between any two neighboring supports. The at least three supports may constitute the burner head that stably supports the cooking utensil. Particularly, for a support that basically extends in a straight line, the cooking utensil can be more stably supported by more than three supports. In addition, a gap exists between any two neighboring supports. This may provide a supply of air to supply secondary air for burning of gas from gas ports on the supports, so as to avoid affecting the thermal efficiency of the burner head and a high carbon monoxide CO content that are caused by incomplete burning of gas through each gas port.

In a possible implementation, the sizes of a plurality of gas ports are gradually decreasing from a center of the burner head toward the periphery. Therefore, a central region of the burner head has a larger total area of flame ports, and flames on the burner head are concentrated. During burning, because more flames gather in a central region of a bottom of a cooking utensil, heat of the flames is more effectively utilized, so that the thermal efficiency of the burner head can be improved.

In a possible implementation, the gas port is of a long narrow shape, and a length direction of the gas port is perpendicular to an extension direction of the support. By using this improved solution, a gas port having a large area may be formed on a same support and a floating flame is not easily generated. The gas port of the long narrow shape has a larger contact surface with secondary air, so that the secondary air is supplied more sufficiently.

In a possible implementation, each support includes at least one side wall that smoothly extends, the gas ports are only formed on one side wall of each support, and the gas ports on the supports face a same direction and are along a clockwise direction or a counterclockwise direction of the burner head. For a burner head that includes relatively more supports, for example, a burner head that includes six or more supports, a gap between two neighboring supports is small. To avoid problems that flames on two neighboring supports crash and secondary air is insufficiently supplied, the gas ports are only formed on one side wall of each support, and the gas ports on the supports face a same direction.

In a possible implementation, each support includes two oppositely disposed side walls that smoothly extend, and a plurality of gas ports is formed on both of the two side walls. For a burner head that includes relatively less supports, for example, a burner head that includes five or less supports, a gap between two neighboring supports is sufficiently large. To ensure the thermal efficiency of the burner head, the gas ports are formed on the two oppositely disposed side walls.

In a possible implementation, the side wall is of a triangular shape. In this way, when the gas ports are formed on the side walls, regardless of circular gas ports or strip gas ports, it is easy to implement that a central region of the burner head has a larger total area of flame ports, and flames are more concentrated during burning.

In a possible implementation, the support is of a wedged shape. When a tip of the wedge-shaped support is disposed facing outward, a part of the support facing a center of the burner head has a larger surface area per unit length. Based on such a structure arrangement, a central region of the burner head may have a larger total area of flame ports, so that flames on the burner head are concentrated. In an embodiment, a range in which a center of the burner head extends radially outward to half of the length of the support is defined as the central region of the burner head. During burning, because more flames gather in a central region of a bottom of a cooking utensil, heat of the flames is more effectively utilized, so that the thermal efficiency of the burner head can be improved. In addition, when the cooking utensil is directly placed on the burner head, in this solution, a gap supposed to exist between the burner head and the cooking utensil in the existing technology is cancelled. Therefore, for burning of gas from the gas ports, secondary air needs to be supplied by using another structure. A gap is formed between the wedge-shaped support and a panel of the gas cooktop, and sufficient secondary air for burning of gas from the gas ports may be supplied through the gap, to reduce carbon monoxide CO during burning.

In a possible implementation, the supports gather together, or the supports are connected together. An end of the support facing or located at a center of the burner head is defined as a head end, and an end of the support away from the center of the burner head is defined as a tail end. That the supports gather together should be understood as that the distance between head ends of any two neighboring supports is less than the distance between tail ends thereof.

In a possible implementation, the supports extend radially outward away from the center of the burner head. In this way, the burner head obtains uniform fire in a circumferential direction, so that a bottom of a cooking utensil is heated more uniformly. In addition, the supports may uniformly support the cooking utensil, and more uniform forces are applied to the supports and the cooking utensil is more stably supported.

In a possible implementation, the supports form a Y-shaped, a cross-shaped, a pentagram-shaped, or an eight-spoked-asterisk-shaped burner head.

In a possible implementation, the burner head further includes an automatic detection apparatus, where the automatic detection apparatus is configured to automatically detect a bottom outline of the cooking utensil placed on the burner head, and the burner head is further configured to be automatically located, based on a detection result of the automatic detection apparatus, in a working position that matches the bottom outline of the cooking utensil. For example, the burner head is provided with a retractable rod-shaped substance at a position near a tail end of one support, and is provided with a micro switch. The micro switch is connected to one controller, and the rod-shaped substance does not move with the support. When the cooking utensil is placed on the burner head, if the cooking utensil presses down the rod-shaped substance to trigger the micro switch, if the controller determines that the cooking utensil is a pan according to a signal of the micro switch, the controller controls the burner head to be in the first working position. When the cooking utensil is placed on the burner head, if the micro switch is not triggered, the controller determines that the cooking utensil is a pot. The controller controls the burner head to be in the second working position. Certainly, a person skilled in the art may further figure out more implementations to perform the foregoing determining, for example, using a Hall effect sensor.

In a possible implementation, the supports are rotatable.

In a possible implementation, the supports are configured to be electrically driven to the first working position and the second working position.

The present invention further provides a burner for a gas cooktop, including a burner head of a burner for a gas cooktop described above.

Finally, the present invention provides a gas cooktop, including a burner for a gas cooktop described above.

In a possible implementation, the gas cooktop includes a panel, and when the support is in the first working position, a support surface of the support is parallel to the panel; or when the support is in the second working position, a support surface inclines to the panel. Therefore, when the supports are in the first working position, the support surfaces of the supports parallel to the panel constitute a flat upper surface of a burner head. When the supports are in the second working position, the support surfaces of the supports constitute a concave surface.

In a possible implementation, the burner head is disposed above the panel, and when the support is in any working position, a gap exists between the support and the panel. In the present invention, the burner head is directly configured to support a cooking utensil. In this solution, a gap supposed to exist between the burner head and the cooking utensil in the existing technology is cancelled. Therefore, for burning of gas through gas ports, secondary air needs to be supplied by using another structure and design. A gap is formed between the support and a panel of the gas cooktop, and sufficient secondary air for burning of gas from the gas ports may be supplied through the gap, to reduce carbon monoxide CO during burning.

In a possible implementation, the gas cooktop further includes a base mechanism that supports the support, and the base mechanism includes a rotating shaft to enable the support to be rotatable, to adapt to bottom outlines of different cooking utensils.

In a possible implementation, the base mechanism further includes a lifting structure that enables the support to move up and down. In this way, the burner head may protrude from the panel by different heights to meet different requirements. If the burner head needs a small amount of secondary air, the height that the burner head protrudes from the panel may be decreased.

LIST OF REFERENCE NUMERALS

1: Gas cooktop; 2: Burner head; 3: Panel; 4: Operating knob; 10: Base mechanism; 20: Support; 21: Support surface; 22 and 23: Side wall; 200: Gas port; 1S: Upper surface; 2S: Concave surface; and G1 and G2: Gap.

DETAILED DESCRIPTION

To further understand the objective, construction, features, and functions of the present invention, descriptions are provided in detail with reference to embodiments as follows.

Figure 1:
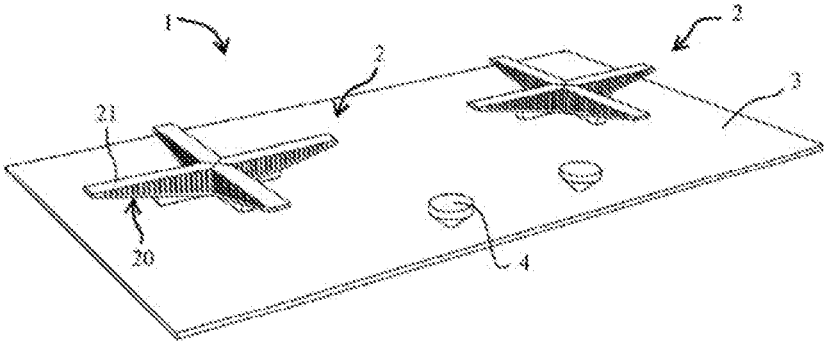
FIG. 1 is a three-dimensional diagram of a gas cooktop when all supports are in a first working position according to an embodiment of the present invention.
Figure 2:
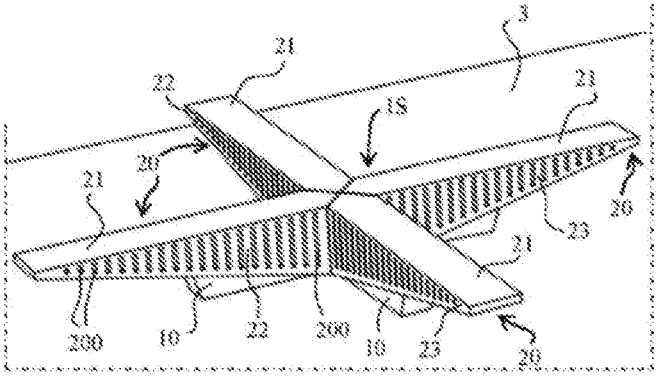
FIG. 2 is an enlarged schematic diagram of a burner head of the gas cooktop according to the embodiment shown in FIG. 1.
Figure 3:
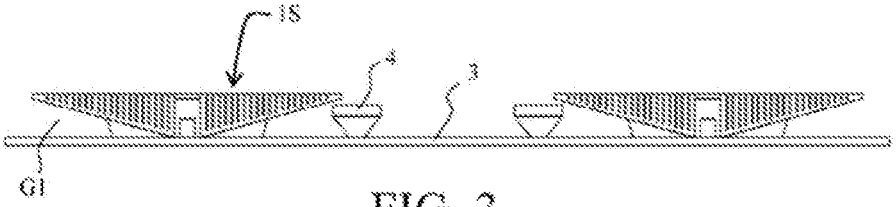
FIG. 3 is a front view of the embodiment shown in FIG. 1.
Figure 4:
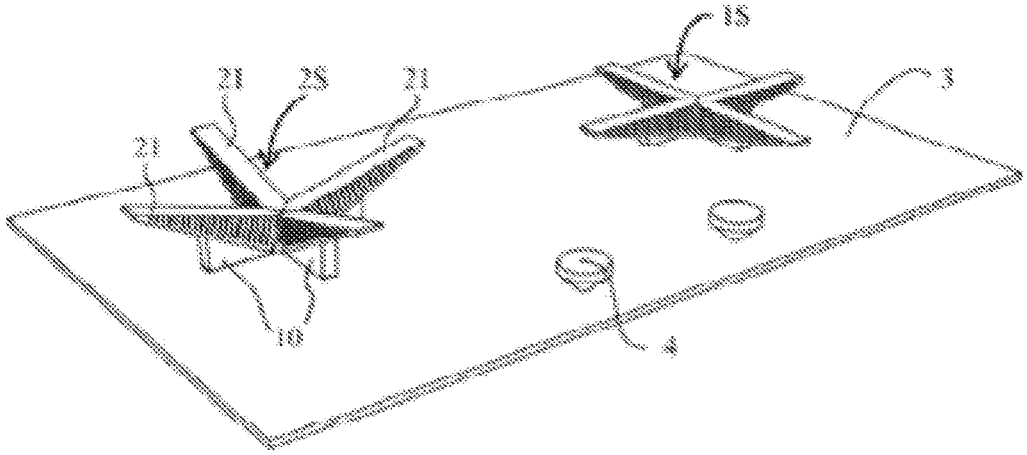
FIG. 4 is a three-dimensional diagram of a gas cooktop when supports of one burner head are in a first working position and supports of the other burner head are in a second working position according to an embodiment of the present invention.
Figure 5:
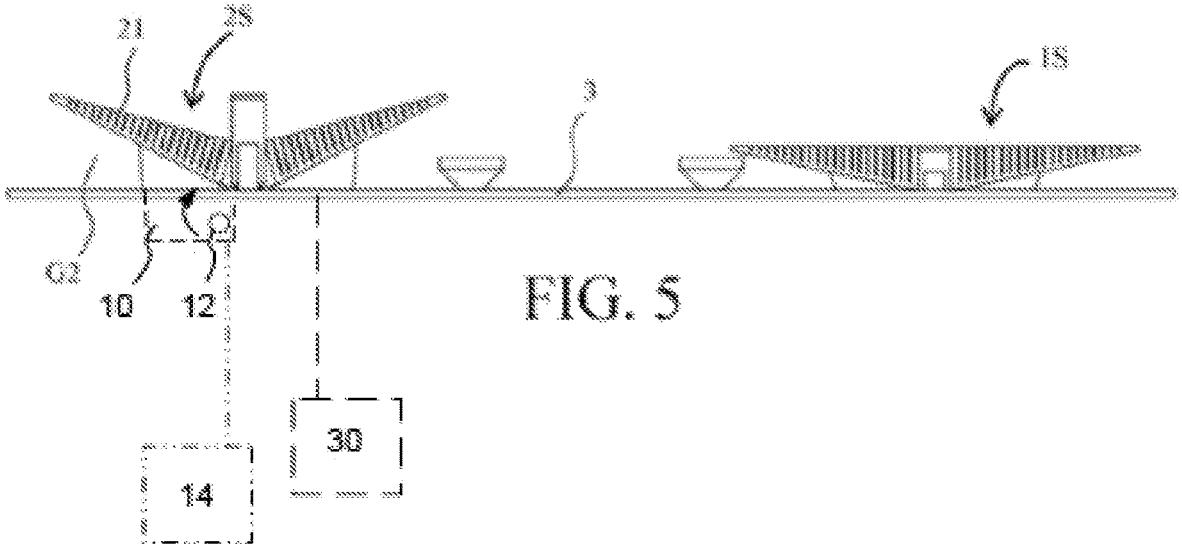
FIG. 5 is a front view of the gas cooktop according to the embodiment shown in FIG. 4.

FIG. 1 is a three-dimensional diagram of a gas cooktop when all supports are in a first working position according to an embodiment of the present invention. FIG. 2 is an enlarged schematic diagram of a burner head of the gas cooktop according to the embodiment shown in FIG. 1. FIG. 3 is a front view of the embodiment shown in FIG. 1, and FIG. 3 only shows a part of the gas cooktop located on a panel. FIG. 4 is a three-dimensional diagram of a gas cooktop when supports of one burner head are in a first working position and supports of the other burner head are in a second working position according to an embodiment of the present invention. FIG. 5 is a front view of the gas cooktop according to the embodiment shown in FIG. 4, and FIG. 5 only shows a part of the gas cooktop located on a panel.

The gas cooktop 1 includes a panel 3 and two burner heads 2. An operating knob 4 is correspondingly disposed for a burner head 2 on the panel 3, so that a user enables and disables the burner head 2 and controls fire in the burner head 2 by using the operating knob 4. Certainly, to ensure integrity of the panel 3, the gas cooktop 1 to have a simpler appearance, and the user to clean the panel more conveniently, the panel 3 may be provided with a touch unit to replace the operating knob 4 to control the burner head. In addition, a projection apparatus may be disposed on a cooker hood above the gas cooktop 1, to project control information on the panel 3. The panel 3 is preferably made of black glass. An operation action of the user on the panel 3 may be captured and converted into a control instruction to control the gas cooktop 1.

In this embodiment, the burner head 2 of a burner for the gas cooktop includes four supports 20. Four ends of the four supports 20 gather together, and a gap exists between any two neighboring supports 20. The supports 20 extend radially outward away from the center of the burner head 2, and the four supports 20 form a cross-shaped burner head 2.

For a specific structure of the supports 20, descriptions are provided below.

Figure 7:
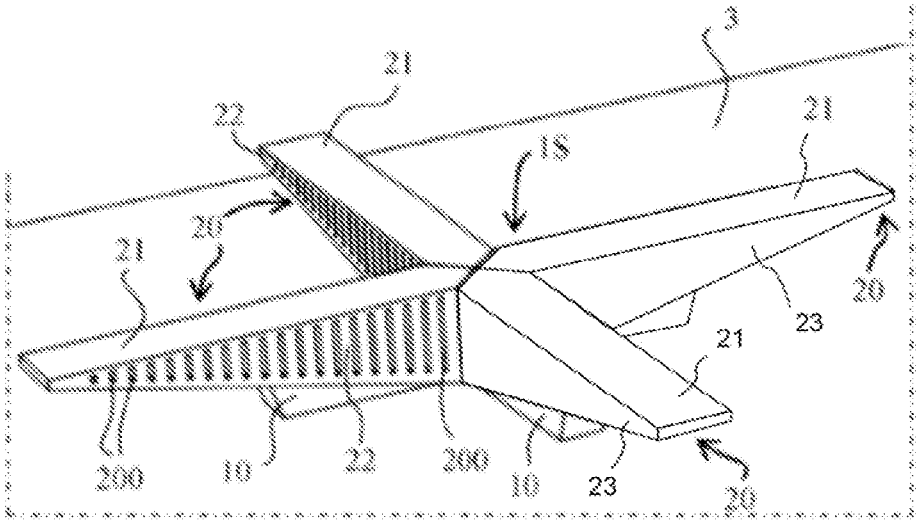
FIG. 7 is schematic diagram of a burner head of the gas cooktop according to an exemplary embodiment of the invention.

Specifically, each support 20 includes a support surface 21 configured to support a cooking utensil. The support 20 is further provided with a plurality of gas ports 200 from which gas flows out and forms a flame. As shown in FIG. 2, each support 20 includes two oppositely disposed side walls 22 and 23 that smoothly extend, and the side walls 22 and 23 are respectively connected to the support surface 21. A plurality of gas ports 200 is formed on both of the side walls 22 and 23. To prevent soup and overflow from splashing on the support and blocking the gas ports 200, in an embodiment of the present invention, a convex edge (not shown) protruding outward is formed at a connection position of the side wall 22 or 23 and the support surface 21. In an exemplary embodiment illustrated in FIG. 7, the gas ports (200) are only formed on one side wall (22) of each support (20), and the gas ports (200) on the supports (20) face a same direction and are along a clockwise direction or a counterclockwise direction of the burner head (2).

In this embodiment, the support 20 is of a wedged shape, and a tip of the support 20 is disposed facing outward. The side walls 22 and 23 are triangular. The gas port 200 is a long narrow strip-shaped hole, and a length direction of the gas port 200 is perpendicular to an extension direction of the support 20. The plurality of gas ports 200 on each side wall is distributed in such a way that the size of the gas port 200 is gradually decreasing from a center of the burner head 2 toward the periphery. If an end of the support 20 located at the center of the burner head is defined as a head end, and an end of the support 20 away from the center of the burner head is defined as a tail end, from the head end to the tail end of the support, the gas port 200 on each side wall has a gradually decreasing size in the length direction.

A gas channel that has a same extension direction as that of the support 20 may be formed inside the support 20, and each gas port 200 is in communication with the gas channel. Preferably, the gas channel is also of a wedged shape. Gas may be fed to the gas channel by using a related channel in a base mechanism 10 formed below the support 20.

Each support 20 has at least two working positions, and the at least two working positions include a first working position and a second working position. When the supports 20 are in the first working position, the burner head 2 has a flat upper surface 1S, and the support surfaces 21 of the supports 20 constitute the upper surface 1S, as shown in FIG. 1 to FIG. 3. In this case, the burner head 2 is more appropriate to support a flat-bottomed cooking utensil, for example, a frying pan. When the supports 20 are in the second working position, the burner head 2 has a concave surface 2S, and the support surfaces 21 of the supports 20 constitute the concave surface 2S, as shown in FIG. 4 and FIG. 5. In this case, the burner head 2 is more appropriate to support an arc-bottomed cooking utensil, for example, a round-bottomed frying wok.

When the support 20 is in the first working position, the support surface 21 of the support 20 is parallel to the panel 3, so that the burner head 2 has a flat upper surface 1S. When the support 20 is in the second working position, the support surface 21 of the support 20 inclines to the panel 3, so that the burner head 2 has a concave surface 2S. In this case, the burner head 2 is of a concave shape as a whole.

As shown in FIG. 3, in this embodiment, the burner head 2 is disposed above the panel 3. When the support 20 is in the first working position, a gap G1 exists between the support 20 and the panel 3. When the support 20 is in the second working position, a gap G2 exists between the support 20 and the panel 3. More sufficient secondary air for burning of gas from the gas port 200 may be supplied by arrangement of the gaps G1 and G2.

The gas cooktop 1 further includes a base mechanism 10 for supporting the support 20. In fact, an opening hole is formed on the panel 3 corresponding to the base mechanism 10, and the base mechanism 10 partially extends into the gas cooktop 1 through the opening hole. The base mechanism 10 includes a rotating shaft 12 (as schematically shown in FIG. 5) to enable the support 20 to be rotatable. Therefore, the support 20 may rotate from the first working position to the second working position, and rotate from the second working position to the first working position, so as to adapt to bottom outlines of different cooking utensils.

In this embodiment, the supports 20 are configured to be electrically driven to the first working position and the second working position. In this way, the user may control the working position of the supports by using the operating knob 4 or the touch unit disposed on the panel 3. A mechanism driving the supports 20 to rotate may be a motor, for example, a stepper motor. A person skilled in the art should recognize that, conversion between the first working position and the second working position of the supports may alternatively be implemented in another actuating manner, for example, a mechanical, hydraulic, pneumatic, or manual operation manner. For example, a mechanical structure including a spring is used. The user manually presses a cooking utensil to apply a force to the supports, and the supports automatically bounce from the first working position to the second working position after being pressed down. When the user presses the cooking utensil again to press down the supports, the supports return from the second working position to the first working position. However, this solution is applicable to supports each having two working positions. For supports each having more working positions, it is complex to use this solution.

The foregoing is merely an embodiment of the present invention, and more embodiments of the present invention may be obtained by means of changes, modifications, and combinations. For example, the support 20 further includes more working positions in addition to the first working position and the second working position. For example, the support may have three working positions. When the support is respectively in the three working positions, angles between the support surface 21 and the panel 3 are 0°, 30°, and 60° respectively, to adapt to cooking utensils having different bottom outlines. In another embodiment, the support 20 may be adjusted steplessly, so that the support 20 may stay in any working position where the support surface 21 is parallel to the panel 3 or perpendicular to the panel 3. In an embodiment, the burner head 2 of the burner for the gas cooktop further includes an automatic detection apparatus 30, as schematically illustrated in FIG. 5. The automatic detection apparatus is configured to automatically detect a bottom outline of the cooking utensil placed on the burner head 2, and the burner head 2 is further configured to be automatically located, based on a detection result of the automatic detection apparatus, in a working position that matches the bottom outline of the cooking utensil.

In addition to the foregoing wedged shape, the support 20 may further be constructed into another shape. In an embodiment, the support is constructed into such a shape that enables a gap, for example, an L-shaped gap or a U-shaped gap, to exist between the support and the panel when the support is in any working position.

For another example, in another embodiment of the present invention, the base mechanism 10 further includes a lifting structure 14 (as schematically illustrated in FIG. L that enables the support 20 to move up and down. In this way, when the gas cooktop 1 is disabled, the support 20 returns to the first working position. That is, the support 20 returns to a working position where the support surface 21 of the support 20 is parallel to the panel of the gas cooktop. Subsequently, by using the lifting structure 14, the support is lowered to a position where the support surface 21 is basically flush with the panel of the gas cooktop. In this way, after the gas cooktop is disabled, the entire gas cooktop may be a flat entirety that smoothly extends on the panel, other than the operating knob. Certainly, the operating knob may also be constructed as a removable magnetic knob, or be constructed as a touch unit on the panel. In this way, when in a disabled state, the gas cooktop is presented as a panel that smoothly extends. In this embodiment, the support may be constructed into a shape of a spherical cap, or be constructed into a shape of a remaining part of a cylinder after the cylinder is cut by a plane parallel to an axis of the cylinder.

Figure 6:
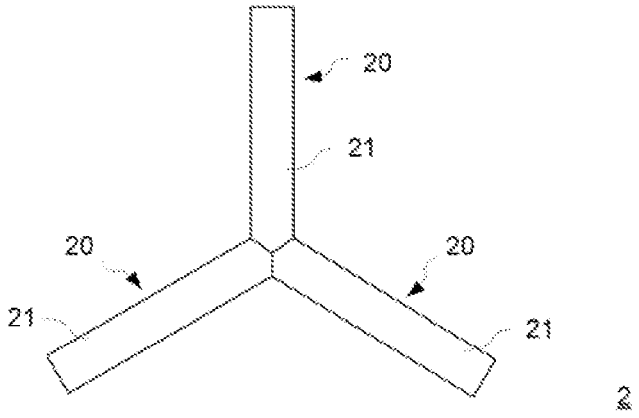
FIG. 6 is schematic top view of a burner head of the gas cooktop according to an exemplary embodiment of the invention.

In other embodiments of the present invention, the burner head may include three, five, six, or more supports. Three supports constitute a Y-shaped burner head, as schematically illustrated, for example, in FIG. 6. Five supports constitute a pentagram-shaped burner head. Six supports constitute an eight-spoked-asterisk-shaped burner head.

In another embodiment of the present invention, the supports 20 included by the burner head 2 gather together in such a way that head ends of the supports are spaced apart from each other. However, in another embodiment, the supports 20 are connected together.

For another example, a difference between the another embodiment of the present invention and the embodiment shown in FIG. 1 to FIG. 5 lies in that the burner head 2 includes six supports, the gas ports 200 are only formed on one side wall 22 of each support 20, and the gas ports 200 on the supports 20 face a same direction and are along a counterclockwise direction of the burner head 2.

The present invention further provides a burner for a gas cooktop 1, including the burner head 2 according to any one of the foregoing embodiments.

The embodiments of single parts described with reference to FIG. 1 to FIG. 5 may be combined with each other in any given manner to achieve advantages of the present invention.

The present invention is described by the foregoing related embodiments. However, the foregoing embodiments are merely examples for implementing the present invention. It should be noted that, the disclosed embodiments do not limit the scope of the present invention. On the contrary, variations and modifications made without departing from the spirit and scope of the present invention fall within the patent protection scope of the present invention.

The invention claimed is:

1. A burner head of a burner for a gas cooktop, said burner head comprising a plurality of supports, each support comprising a support surface for supporting a cooking utensil and a plurality of gas ports for gas to flow out and to form a flame, said supports being movable between a first working position in which the support surfaces of the supports form a flat upper surface of the burner head, and a second working position in which the support surfaces of the supports form a concave surface of the burner head, wherein at least three of the supports are provided, with a gap being defined between any two neighboring supports of the supports.

2. The burner head of claim 1, wherein each support comprises a smooth side wall, said gas ports of each support being formed only on said side wall, wherein the gas ports of the supports face a same direction and are along a clockwise direction or a counterclockwise direction of the burner head.

3. The burner head of claim 1, wherein each support comprises two oppositely disposed smooth side walls, said gas ports being formed on both said side walls.

4. The burner head of claim 1, wherein each support is of a wedged shape defining a pointed end which is disposed outward.

5. The burner head of claim 1, wherein the supports gather together, or the supports are connected together.

6. The burner head of claim 1, wherein the supports extend radially outward away from a center of the burner head.

7. The burner head of claim 1, further comprising an automatic detection apparatus configured to automatically detect a bottom outline of the cooking utensil placed on the burner head, said supports assuming one of the first and second working position in response to a detection result by the detection apparatus so that the burner head automatically matches the bottom outline of the cooking utensil.

8. The burner head of claim 1, wherein the supports are configured to be electrically driven to the first working position and the second working position.

9. A burner for a gas cooktop, comprising a burner head, said burner head comprising a plurality of supports, each support comprising a support surface for supporting a cooking utensil and a plurality of gas ports for gas to flow out and to form a flame, said supports being movable between a first working position in which the support surfaces of the supports form a flat upper surface of the burner head, and a second working position in which the support surfaces of the supports define a concave surface of the burner head, wherein the supports extend radially outward away from a center of the burner head.

10. The burner of claim 9, wherein at least three of the supports are provided, with a gap being defined between any two neighboring supports of the supports.

11. The burner of claim 9, wherein each support comprises a smooth side wall, said gas ports of each support being formed only on said side wall, wherein the gas ports of the supports face a same direction and are along a clockwise direction or a counterclockwise direction of the burner head.

12. The burner of claim 9, wherein each support comprises two oppositely disposed smooth side walls, said gas ports being formed on both said side walls.

13. The burner of claim 9, wherein each support is of a wedged shape defining a pointed end which is disposed outward.

14. The burner of claim 9, wherein the supports gather together, or the supports are connected together.

15. The burner of claim 9, wherein the burner head includes an automatic detection apparatus configured to automatically detect a bottom outline of the cooking utensil placed on the burner head, said supports assuming one of the first and second working position in response to a detection result by the detection apparatus so that the burner head automatically matches the bottom outline of the cooking utensil.

16. The burner of claim 9, wherein the supports are configured to be electrically driven to the first working position and the second working position.

17. A gas cooktop, comprising a burner comprising a burner head which includes a plurality of supports, each support comprising a support surface for supporting a cooking utensil and a plurality of gas ports for gas to flow out and to form a flame, said supports being movable between a first working position in which the support surfaces of the supports form a flat upper surface of the burner head, and a second working position in which the support surfaces of the supports of the burner head form a concave surface of the burner head and a panel, said support surface of each support extending in the first working position in parallel relationship to the panel; and in the second working position at an incline in relation to the panel.

18. The gas cooktop of claim 17, wherein the burner head is disposed above the panel, with a gap being defined between the supports and the panel, when the supports are in any of the first and second working positions.

19. The gas cooktop of claim 17, further comprising base mechanisms configured to support the supports in one-to-one correspondence, each said base mechanism comprising a rotating shaft to enable the support to be rotatable and to adapt to bottom outlines of different cooking utensils.

* * * * *